US009752239B2

(12) United States Patent
Sato et al.

(10) Patent No.: US 9,752,239 B2
(45) Date of Patent: Sep. 5, 2017

(54) ELECTROCHEMICAL REDUCTION DEVICE AND METHOD FOR MANUFACTURING HYDRIDE OF AROMATIC HYDROCARBON COMPOUND OR NITROGEN-CONTAINING HETEROCYCLIC AROMATIC COMPOUND

(71) Applicant: JX Nippon Oil & Energy Corporation, Chiyoda-ku (JP)

(72) Inventors: Yasushi Sato, Chiyoda-ku (JP); Kota Miyoshi, Chiyoda-ku (JP); Kojiro Nakagawa, Chiyoda-ku (JP); Yoshihiro Kobori, Chiyoda-ku (JP)

(73) Assignee: JX NIPPON OIL & ENERGY CORPORATION, Tokyo (JP)

( * ) Notice: Subject to any disclaimer, the term of this patent is extended or adjusted under 35 U.S.C. 154(b) by 384 days.

(21) Appl. No.: 14/566,901

(22) Filed: Dec. 11, 2014

(65) Prior Publication Data

US 2015/0090602 A1 Apr. 2, 2015

Related U.S. Application Data

(63) Continuation of application No. PCT/JP2013/003700, filed on Jun. 12, 2013.

(30) Foreign Application Priority Data

Jun. 12, 2012 (JP) ..... 2012-133153

(51) Int. Cl.
*C25B 3/04* (2006.01)
*C25B 15/02* (2006.01)

(52) U.S. Cl.
CPC ..... *C25B 3/04* (2013.01); *C25B 15/02* (2013.01)

(58) Field of Classification Search
CPC ..... C25B 3/04; C25B 15/02
See application file for complete search history.

(56) References Cited

U.S. PATENT DOCUMENTS 4,145,264 A 3/1979 Thoma et al.
4,588,484 A 5/1986 Justice, Jr. et al.
(Continued)

FOREIGN PATENT DOCUMENTS

JP 47-027975 A 10/1972
JP 53-113828 A 10/1978
(Continued)

OTHER PUBLICATIONS

European Office Action dated Sep. 29, 2016 issued in corresponding European Patent Appln. No. 13804292.4 (4 pages).
(Continued)

*Primary Examiner* — Nicholas A Smith
(74) *Attorney, Agent, or Firm* — Buchanan Ingersoll & Rooney PC

(57) ABSTRACT

An electrochemical reduction device comprises an electrode unit including an electrolyte membrane, a reduction electrode, and an oxygen evolving electrode; a power control unit that applies a voltage Va between the reduction electrode and the oxygen evolving electrode; a hydrogen gas generation rate measurement unit that measures a hydrogen gas generation rate F1; and a control unit that controls the power control unit so as to gradually increase the Va within a range that satisfies a relationship of F1≤F0 and $V_{CA}>V_{HER}$−acceptable potential difference (APD), when the potential at a reversible hydrogen electrode is $V_{HER}$, the potential of the reduction electrode is $V_{CA}$, the acceptable upper limit of the hydrogen gas generation rate is F0, and the APD is a potential difference that defines an upper limit of a potential difference between $V_{CA}$ and $V_{HER}$.

8 Claims, 5 Drawing Sheets

(56) References Cited

U.S. PATENT DOCUMENTS

| | | | | |
|---|---|---|---|---|
| 2013/0317959 | A1* | 11/2013 | Joos | C25B 15/02 705/34 |
| 2015/0008138 | A1* | 1/2015 | Sato | C25B 15/02 205/423 |

FOREIGN PATENT DOCUMENTS

| | | | |
|---|---|---|---|
| JP | 2003-045449 | A | 2/2003 |
| JP | 2004-211190 | A | 7/2004 |
| JP | 2005-126288 | A | 5/2005 |
| JP | 2005-239479 | A | 9/2005 |
| JP | 2009-215647 | A | 9/2009 |
| WO | 2011/122155 | A1 | 10/2011 |

OTHER PUBLICATIONS

European Office Action dated Jan. 23, 2017 issued in corresponding European Patent Appln. No. 13804292.4 (5 pages).

Office Action (Notification of First Office Action) issued on Mar. 4, 2016, by the State Intellectual Property Office of P.R. China in corresponding Chinese Patent Application No. 201380031250.5 and English translation of the Office Action. (24 pages).

Ichikawa, "Novel Infra-Structured Technology of Hydrogen Transportation Present Status and Future Problems," Journal of the Japan Institute of Energy, (2006), vol. 85, No. 7, pp. 517-524.

International Search Report (Form PCT/ISA/210) issued on Sep. 10, 2013, by the Japanese Patent Office in corresponding International Application No. PCT/JP2013/003700, and an English Translation of the International Search Report. (7 pages).

International Preliminary Report on Patentability (Form PCT/IB/373) and the Written Opinion of the International Searching Authority (Form PCT/ISA/237) issued on Dec. 16, 2014, by the International Bureau of WIPO in corresponding International Application No. PCT/JP2013/003700, an and English Translation of the Written Opinion of the International Searching Authority. (10 pages).

Choi et al., "Electrochemical Benzene Hydrogenation using PtRhM/C (M = W, pd, or Mo) Electrocatalysts over a Polymer Electrolyte Fuel Cell System," Applied Catalysis A: General, (May 15, 2009), vol. 359, Issue 1-2, pp. 136-143.

Miller et al., "Electrocatalytic Hydrogenation of Aromatic Compounds," The Journal of Organic Chemistry, (May 1978), vol. 43, No. 10, pp. 2059-2061.

"Properties of Nafion PFSA Membrane," (Nov. 25, 2015), Retrieved from the Internet: URL:http://fuelcellsetc.com/Store/DS/n115-n117-properties.pdf (2 pages).

Yuan et al., "AC Impedance Technique in PEM fuel Cell Diagnosis—A Review," International Journal of Hydrogen Energy, (Nov. 29, 2007), vol. 32, Issue 17, pp. 4365-4380.

The extended European Search Report issued on Jan. 29, 2016, by the European Patent Office in corresponding European Patent Application No. 13804292.4-1360. (6 pages).

* cited by examiner

ELECTROCHEMICAL REDUCTION DEVICE AND METHOD FOR MANUFACTURING HYDRIDE OF AROMATIC HYDROCARBON COMPOUND OR NITROGEN-CONTAINING HETEROCYCLIC AROMATIC COMPOUND

BACKGROUND OF THE INVENTION

1. Field of the Invention

The present invention relates to a device and a method for electrochemically hydrogenating an aromatic hydrocarbon compound or a nitrogen-containing heterocyclic aromatic compound.

2. Description of the Related Art

It is known that a cyclic organic compound such as cyclohexane or decalin is obtained efficiently by hydrogenating a benzene ring of a corresponding aromatic hydrocarbon compound (benzene or naphthalene) using a hydrogen gas. This reaction requires reaction conditions of high temperature and high pressure, and is therefore unsuitable for small to medium scale manufacturing. On the other hand, in an electrochemical reaction using an electrolysis cell, it is not necessary to treat gaseous hydrogen since water can be used as a source of hydrogen, and the reaction is known to proceed under relatively mild reaction conditions (at room temperature to about 200° C. and under normal pressure).

PRIOR ART DOCUMENTS

Patent Documents

Patent Document 1: Japanese Patent Laid-Open No. 2003-045449

Patent Document 2: Japanese Patent Laid-Open No. 2005-126288

Patent Document 3: Japanese Patent Laid-Open No. 2005-239479

Non-Patent Document

Non-Patent Document 1: Masaru Ichikawa, J. Jpn. Inst. Energy, vol. 85, 517 (2006)

As an example of electrochemically hydrogenating a benzene ring of an aromatic hydrocarbon compound such as toluene or the like, a method has been reported in which toluene that is vaporized into a gaseous state is sent to the reduction electrode side to obtain methylcyclohexane, which is a hydride in which the benzene ring is hydrogenated, without going a state of a hydrogen gas, in a configuration similar to that of water electrolysis (see Masaru Ichikawa, J. Jpn. Inst. Energy, vol. 85, 517 (2006)), but the amount of substance that can be transformed per electrode unit/time (current density) is not large, and it has been difficult to industrially hydrogenate a benzene ring of an aromatic hydrocarbon compound or a nitrogen-containing heterocyclic aromatic compound.

SUMMARY OF THE INVENTION

The present invention has been devised in view of the problem described above, and an object thereof is to provide a technique capable of electrochemically hydrogenating a benzene ring of an aromatic hydrocarbon compound or a nitrogen-containing heterocyclic aromatic compound with high efficiency.

An aspect of the present invention is an electrochemical reduction device. The electrochemical reduction device includes: an electrode unit including an electrolyte membrane having ionic conductivity, a reduction electrode that is provided on one side of the electrolyte membrane and that contains a reduction catalyst for hydrogenating a benzene ring of an aromatic hydrocarbon compound or a nitrogen-containing heterocyclic aromatic compound, and an oxygen evolving electrode that is provided on the other side of the electrolyte membrane; a power control unit that applies a voltage Va between the reduction electrode and the oxygen evolving electrode so that the reduction electrode has a basic potential and the oxygen evolving electrode has a noble potential; a hydrogen gas generation rate measurement unit that measures a generation rate F1 per unit time of a hydrogen gas generated by an electrolytic reaction of water which competes with a benzene ring hydrogenation reaction of the aromatic hydrocarbon compound or the nitrogen-containing heterocyclic aromatic compound; and a control unit that controls the power control unit so as to gradually increase the voltage Va within a range that satisfies a relationship of $F1 \leq F0$ and $V_{CA} > V_{HER}$−(acceptable potential difference), where the potential at a reversible hydrogen electrode, the potential of the reduction electrode and the acceptable upper limit of the hydrogen gas generation rate are expressed as $V_{HER}$, $V_{CA}$ and F0, respectively, and the acceptable potential difference is defined as a potential difference that defines an upper limit of a potential difference between $V_{CA}$ and $V_{HER}$. In the electrochemical reduction device of the above-described aspect, the acceptable potential difference may be 20 mV.

The electrochemical reduction device of the above-described aspect may further include: a reference electrode that is arranged to be in contact with the electrolyte membrane and to be electrically isolated from the reduction electrode and the oxygen evolving electrode and that is held at a reference electrode potential $V_{Ref}$; and a voltage detection unit that detects a potential difference $\Delta V_{CA}$ between the reference electrode and the reduction electrode, wherein the control unit acquires the potential $V_{CA}$ of the reduction electrode based on the potential difference $\Delta V_{CA}$ and the reference electrode potential $V_{Ref}$.

Another aspect of the present invention is an electrochemical reduction device. The electrochemical reduction device includes: an electrode unit assembly in which a plurality of electrode units are electrically connected to one another in series, the electrode units each including an electrolyte membrane having ionic conductivity, a reduction electrode that is provided on one side of the electrolyte membrane and that contains a reduction catalyst for hydrogenating a benzene ring of an aromatic hydrocarbon compound or a nitrogen-containing heterocyclic aromatic compound, and an oxygen evolving electrode that is provided on the other side of the electrolyte membrane; a power control unit that applies a voltage $V_A$ between a positive electrode terminal and a negative electrode terminal of the electrode unit assembly; so that in each electrode unit, the reduction electrode has a basic potential and the oxygen generating electrode has a noble potential; a hydrogen gas generation rate measurement unit that measures a generation rate F1' per unit time of a hydrogen gas generated by an electrolytic reaction of water which competes with a benzene ring hydrogenation reaction of the aromatic hydrocarbon compound or the nitrogen-containing heterocyclic aromatic compound in the whole of a plurality of electrode units; and a control unit that controls the power control unit so as to gradually increase the voltage $V_A$ within a range that satisfies a relationship of $F1' \leq N \times F0$ and $V_{CA} > V_{HER}$−(acceptable potential difference), where the potential at a reversible hydrogen electrode, the potential of the reduction electrode, the acceptable upper limit of the hydrogen gas generation rate per electrode unit and the number of electrode units are expressed as $V_{HER}$, $V_{CA}$, F0 and N, respectively, and the acceptable potential difference is defined as a potential difference that defines an upper limit of a potential difference between $V_{CA}$ and $V_{HER}$. In the electrochemical reduction device of the above-described aspect, the acceptable potential difference may be 20 mV.

The electrochemical reduction device of the above-described aspect may further include: a reference electrode that is arranged to be in contact with the electrolyte membrane of any one of the electrode units included in the electrode unit assembly and to be electrically isolated from the reduction electrode and the oxygen evolving electrode of the electrode unit; and a voltage detection unit that detects a potential difference $\Delta V_{CA}$ between the reference electrode and the reduction electrode of the electrode unit, wherein the control unit acquires the potential $V_{CA}$ of the reduction electrode of the electrode unit based on the potential difference $\Delta V_{CA}$ and the reference electrode potential $V_{Ref}$.

Another aspect of the present invention is a method for manufacturing a hydride of an aromatic hydrocarbon compound or a nitrogen-containing heterocyclic aromatic compound. The method for manufacturing a hydride of an aromatic hydrocarbon compound or a nitrogen-containing heterocyclic aromatic compound includes introducing an aromatic hydrocarbon compound or a nitrogen-containing heterocyclic aromatic compound to the reduction electrode side of the electrode unit, circulating water or a humidified gas to the oxygen evolving electrode side, and hydrogenating a benzene ring of the aromatic hydrocarbon compound or the nitrogen-containing heterocyclic aromatic compound introduced to the reduction electrode side, by using the electrochemical reduction device of any one of the above-described aspects. In the manufacturing method of this aspect, the aromatic hydrocarbon compound or the nitrogen-containing heterocyclic aromatic compound to be introduced to the reduction electrode side may be introduced to the reduction electrode side in a liquid state at a reaction temperature.

Combinations of the above-described elements will also be within the scope of the present invention sought to be patented by the present patent application.

BRIEF DESCRIPTION OF THE DRAWINGS

Embodiments will now be described, byway of example only, with reference to the accompanying drawings, which are meant to be exemplary, not limiting, and wherein like elements are numbered alike in several figures, in which.

DETAILED DESCRIPTION OF THE INVENTION

The invention will now be described by reference to the preferred embodiments. This does not intend to limit the scope of the present invention, but to exemplify the invention.

Embodiments of the present invention will be described below with reference to the drawings. In the figures, like numerals represent like constituting elements, and the description thereof is omitted appropriately.

Embodiment 1

Figure 1:
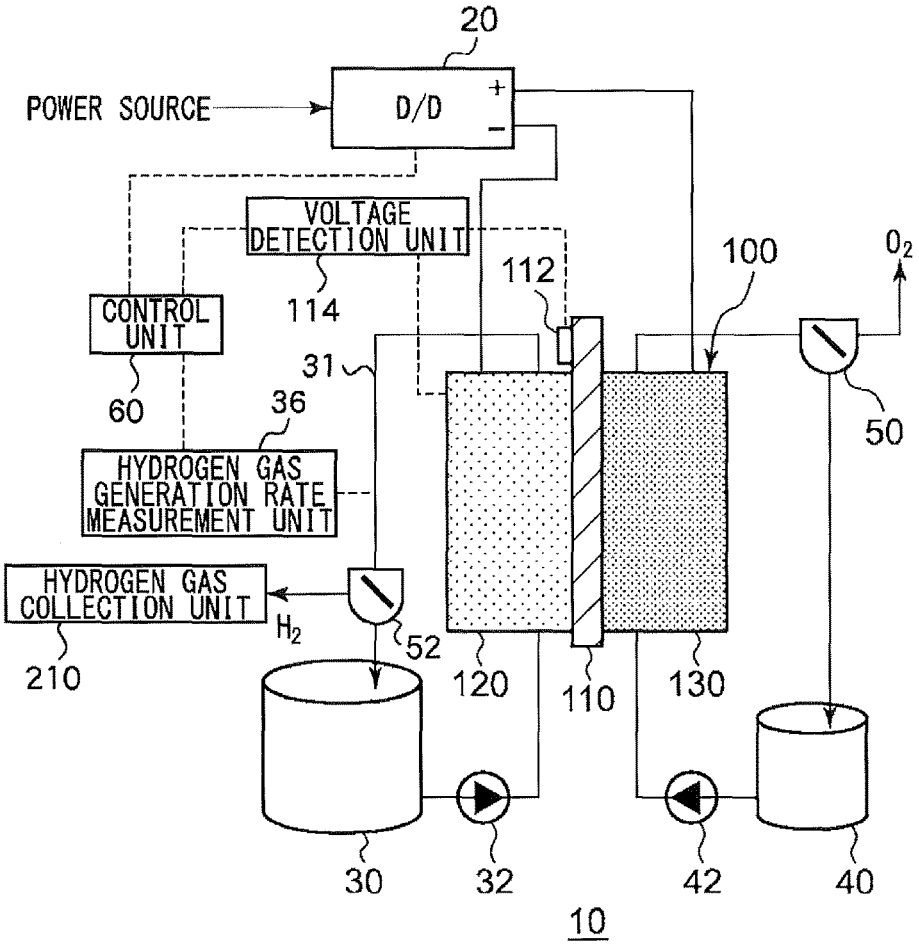
FIG. 1 is a schematic diagram illustrating the general configuration of an electrochemical reduction device according to an embodiment 1.
Figure 2:
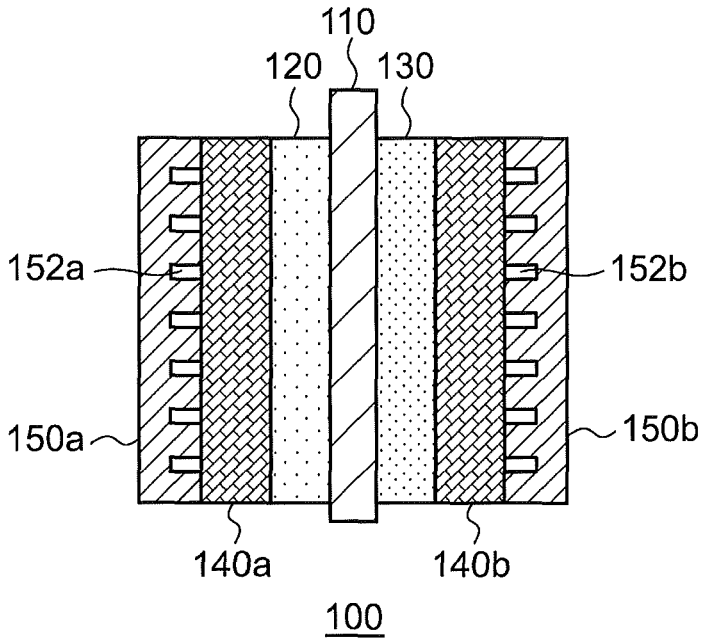
FIG. 2 is a diagram illustrating the general configuration of an electrode unit of the electrochemical reduction device according to the embodiment 1.

FIG. 1 is a schematic diagram illustrating the general configuration of an electrochemical reduction device 10 according to an embodiment. FIG. 2 is a diagram illustrating the general configuration of an electrode unit 100 of the electrochemical reduction device 10 according to the embodiment. As shown in FIG. 1, the electrochemical reduction device 10 includes an electrode unit 100, a power control unit 20, an organic material storage tank 30, a hydrogen gas generation rate measurement unit 36, a water storage tank 40, a gas-water separation unit 50, a gas-liquid separation unit 52, a control unit 60 and a hydrogen gas collection unit 210.

The power control unit 20 is, for example, a DC/DC converter for converting the output voltage of a power source into a predetermined voltage. The positive electrode output terminal of the power control unit 20 is connected to the positive electrode of the electrode unit 100. The negative electrode output terminal of the power control unit 20 is connected to the negative electrode of the electrode unit 100. With this, a predetermined voltage is applied between an oxygen evolving electrode (positive electrode) 130 and a reduction electrode (negative electrode) 120 of the electrode unit 100. A reference electrode input terminal of the power control unit 20 is connected to a reference electrode 112 provided on an electrolyte membrane 110 that is described later, and the potential of the positive electrode output terminal and the potential of the negative electrode output terminal are determined based on the potential of the reference electrode 112 in accordance with an instruction from the control unit 60. As the power source, electrical power derived from natural energy such as sunlight, wind power, and the like can be used. The mode of potential control of the positive electrode output terminal and the negative electrode output terminal by the control unit 60 will be described later.

The organicmaterial storage tank 30 stores an aromatic compound. The aromatic compound used in the present embodiment is an aromatic hydrocarbon compound or a nitrogen-containing heterocyclic aromatic compound, which contains at least one aromatic ring, and examples thereof include benzene, naphthalene, anthracene, diphenylethane, pyridine, pyrimidine, pyrazine, quinoline, isoquinoline, N-alkylpyrrole, N-alkylindole, N-alkyldibenzopyrrole and the like. 1 to 4 hydrogen atoms of the aromatic ring of the aromatic hydrocarbon compound or nitrogen-containing heterocyclic aromatic compound described above may be substituted by alkyl groups. It is to be noted that the "alkyl" of the aromatic compound is a linear or branched alkyl group having 1 to 6 carbon atoms. For example, alkylbenzenes include toluene, ethyl benzene and the like, dialkylbenzenes include xylene, diethylbenzene and the like, and trialkylbenzenes include mesitylene and the like. Alkylnaphthalenes include methylnaphthalene and the like. The aromatic ring of the aromatic hydrocarbon compound or nitrogen-containing heterocyclic aromatic compound described above may have 1 to 3 substituents. In this specification, the aromatic hydrocarbon compound and the nitrogen-containing heterocyclic aromatic compound used in the present invention are referred to as "aromatic compounds" in some cases. The aromatic compound is preferably a liquid at room temperature. When a mixture of two or more of the above-described aromatic compounds is used, the mixture should be a liquid. Consequently, the aromatic compound can be supplied to the electrode unit 100 in a liquid state without performing processes such as heating, pressurizing, and the like, so that the configuration of the electrochemical reduction device 10 can be simplified. The concentration of the aromatic hydrocarbon compound in a liquid state is 0.1% or more, preferably 0.3% or more, more preferably 0.5% or more. This is because if the concentration of the aromatic compound is less than 0.1%, a hydrogen gas is easily generated in a hydrogenation reaction of a desired aromatic compound, and thus the concentration of less than 0.1% is not preferred.

The aromatic compound stored in the organic material storage tank 30 is supplied to the reduction electrode 120 of the electrode unit 100 by a first liquid supply device 32. For the first liquid supply device 32, for example, various types of pumps such as a gear pump, a cylinder pump, or the like or a gravity flow device or the like can be used. Instead of the aromatic compound, a nitrogen-substitution product of the above-described aromatic compound may be used. A circulation pathway is provided between the organic material storage tank 30 and the reduction electrode of the electrode unit 100, and an aromatic compound in which a benzene ring is hydrogenated by the electrode unit 100 and an unreacted aromatic compound pass through the circulation pathway and are stored in the organic material storage tank 30. No gas is generated by a major reaction that proceeds at the reduction electrode 120 of the electrode unit 100, but hydrogen is generated by an electrolytic reaction of water, which competes with a hydrogenation reaction of the benzene ring of the aromatic compound. For removing the hydrogen, the gas-liquid separation unit 52 is provided. The hydrogen gas separated by the gas-liquid separation unit 52 is stored in the hydrogen gas collection unit 210. The hydrogen gas generation rate measurement unit 36 is provided at the front stage of gas-liquid separation unit 52 in a pipeline 31 extending from the reduction electrode 120 to the organic material storage tank 30. The hydrogen gas generation rate measurement unit 36 measures a rate of a hydrogen gas circulating through the pipeline 31 with the aromatic compound. For the hydrogen gas generation rate measurement unit 36, for example, a wet or dry gas meter, a mass flow meter, a soap membrane flow meter or the like, which directly measures a flow rate of a generated gas, can be used. As the hydrogen gas generation rate measurement unit 36, an optical sensor that optically detects gas bubbles from a hydrogen gas, a pressure sensor that detects a pressure in the pipeline 31, or the like can be used. Information about a hydrogen gas generation rate measured in the hydrogen gas generation rate measurement unit 36 is input to the control unit 60, and a hydrogen gas generation rate F1 is calculated based on this information.

The water storage tank 40 stores ion-exchanged water, purified water, and the like (hereinafter, simply referred to as "water"). Water stored in the water storage tank 40 is supplied to the oxygen evolving electrode 130 of the electrode unit 100 by a second liquid supply device 42. For the second liquid supply device 42, for example, various types of pumps such as a gear pump, a cylinder pump, or the like or a gravity flow device or the like can be used as in the case of the first liquid supply device 32. A circulation pathway is provided between the water storage tank 40 and the oxygen evolving electrode of the electrode unit 100, and water that is unreacted in the electrode unit 100 passes through the circulation passway and is stored in the water storage tank 40. The gas-water separation unit 50 is provided in the middle of a pathway where unreacted water is sent back to the water storage tank 40 from the electrode unit 100. By the gas-water separation unit 50, oxygen evolved by the electrolysis of water in the electrode unit 100 is separated from water and discharged to outside the system.

As shown in FIG. 2, the electrode unit 100 includes an electrolyte membrane 110, a reduction electrode 120, an oxygen evolving electrode 130, liquid diffusion layers 140*a* and 140*b*, and separators 150*a* and 150*b*. In FIG. 1, the electrode unit 100 is simplified for illustration, and the liquid diffusion layers 140*a* and 140*b* and the separators 150*a* and 150*b* are omitted.

The electrolyte membrane 110 is formed of a material (ionomer) having protonic conductivity, and inhibits substances from getting mixed or being diffused between the reduction electrode 120 and the oxygen evolving electrode 130 while selectively conducting protons. The thickness of the electrolyte membrane 110 is preferably 5 to 300 μm, more preferably 10 to 150 μm, most preferably 20 to 100 μm. If the thickness of the electrolyte membrane 110 is less than 5 μm, the barrier property of the electrolyte membrane 110 is deteriorated, so that cross-leaking easily occurs. If the thickness of the electrolyte membrane 110 is more than 300 μm, ion transfer resistance becomes too large, and thus the thickness of more than 300 μm is not preferred. However, a reinforcing material may be incorporated into the electrolyte membrane 110 and in this case, the total thickness of the electrolyte membrane 110 including the reinforcing material may exceed the above-described range.

The area specific resistance, that is, ion transfer resistance per geometric area, of the electrolyte membrane 110 is preferably 2000 $m\Omega\cdot cm^2$ or less, more preferably 1000 $m\Omega\cdot cm^2$ or less, and most preferably 500 $m\Omega\cdot cm^2$ or less. If the area specific resistance of the electrolyte membrane 110 is more than 2000 $m\Omega\cdot cm^2$, protonic conductivity becomes insufficient. Examples of the material having protonic conductivity (which is a cation-exchanging ionomer) include perfluorosulfonic acid polymers such as Nafion (registered trademark) and Flemion (registered trademark). The ion exchange capacity (IEC) of the cation-exchanging ionomer is preferably 0.7 to 2 meq/g, more preferably 1 to 1.2 meq/g. If the ion exchange capacity of the cation-exchanging ionomer is less than 0.7 meq/g, ionic conductivity becomes insufficient. On the other hand, if the ion exchange capacity of the cation-exchanging ionomer is more than 2 meq/g, the solubility of the ionomer in water becomes increased, so that the strength of the electrolyte membrane 110 thus becomes insufficient.

On the electrolyte membrane 110, a reference electrode 112 is provided in an area spaced apart from the reduction electrode 120 and the oxygen evolving electrode 130 in such a manner that the reference electrode 112 is in contact with the electrolyte membrane 110. In other words, the reference electrode 112 is electrically isolated from the reduction electrode 120 and the oxygen evolving electrode 130. The reference electrode 112 is held at a reference electrode potential $V_{Ref}$. Examples of the reference electrode 112 include a standard hydrogen reduction electrode (reference electrode potential $V_{Ref}$=0 V) and an Ag/AgCl electrode (reference electrode potential $V_{Ref}$=0.199V), but the reference electrode 112 is not limited thereto. The reference electrode 112 is preferably provided on the surface of the electrolyte membrane 110 on the reduction electrode 120 side.

A potential difference $\Delta V_{CA}$ between the reference electrode 112 and the reduction electrode 120 is detected by a voltage detection unit 114. The value of the potential difference $\Delta V_{CA}$ detected by the voltage detection unit 114 is input to the control unit 60.

The reduction electrode 120 is provided on one side of the electrolyte membrane 110. The reduction electrode 120 is a reduction electrode catalyst layer containing a reduction catalyst for hydrogenating a benzene ring of an aromatic compound. A reduction catalyst used for the reduction electrode 120 is not particularly limited, but is composed of, for example, a metal composition which contains a first catalyst metal (noble metal) containing at least one of Pt and Pd, and one or more second catalyst metals selected from Cr, Mn, Fe, Co, Ni, Cu, Zn, Mo, Ru, Sn, W, Re, Pb, and Bi. The form of the metal composition is an alloy of the first catalyst metal and the second catalyst metal, or an intermetallic compound composed of the first catalyst metal and the second catalyst metal. The ratio of the first catalyst metal to the total mass of the first catalyst metal and the second catalyst metal is preferably 10 to 95 wt %, more preferably 20 to 90 wt %, most preferably from 25 to 80 wt % If the ratio of the first catalyst metal is less than 10 wt %, durability may be deteriorated from the perspective of resistance to dissolving or the like. On the other hand, if the ratio of the first catalyst metal is more than 95 wt %, the properties of the reduction catalyst become closer to those of a noble metal alone, and therefore the electrode activity becomes insufficient. In the following explanation, the first catalyst metal and the second catalyst metal are collectively referred to as "catalyst metals" in some cases.

The above-described catalyst metals may be supported by a conductive material (support). The electrical conductivity of the conductive material is preferably $1.0\times10^{-2}$ S/cm or more, more preferably $3.0\times10^{-2}$ S/cm or more, and most preferably $1.0\times10^{-1}$ S/cm or more. If the electrical conductivity of the conductive material is less than $1.0\times10^{-2}$ S/cm, sufficient conductivity cannot be imparted. Examples of the conductive material include conductive materials containing any one of a porous carbon, a porous metal, and a porous metal oxide as a major component. Examples of the porous carbon include carbon black such as Ketjenblack (registered trademark), acetylene black, Vulcan (registered trademark) and the like. The BET specific surface area of the porous carbon measured by a nitrogen adsorption method is preferably 100 $m^2/g$ or more, more preferably 150 $m^2/g$ or more, and most preferably 200 $m^2/g$ or more. If the BET specific surface area of the porous carbon is less than 100 $m^2/g$, it is difficult to uniformly support the catalyst metals. Therefore, the rate of utilization of a catalyst metal surface is lowered, causing catalyst performance to be degraded. Examples of the porous metal include Pt black, Pd black, a Pt metal deposited in a fractal shape, and the like. Examples of the porous metal oxide include oxides of Ti, Zr, Nb, Mo, Hf, Ta and W. In addition, examples of the porous conductive material for supporting a catalyst metal include nitrides, carbides, oxynitrides, carbonitrides, partially-oxidized carbonitrides of metals such as Ti, Zr, Nb, Mo, Hf, Ta, W and the like (hereinafter, they are collectively referred to as porous metal carbonitrides and the like). The BET specific surface areas of the porous metal, the porous metal oxide, the porous metal carbonitrides and the like measured by a nitrogen adsorption method are preferably 1 $m^2/g$ or more, more preferably 3 $m^2/g$ or more, and most preferably 10 $m^2/g$ or more. If the respective BET specific surface areas of the porous metal, the porous metal oxide, the porous metal carbonitrides and the like are less than 1 $m^2/g$, it is difficult to uniformly support the catalyst metals. Therefore, the rate of utilization of a catalyst metal surface is lowered, causing catalyst performance to be degraded.

Depending on the type and composition of the first catalyst metal and the second catalyst metal, a simultaneous impregnation method in which the support is impregnated with the first catalyst metal and the second catalyst metal at the same time, or a sequential impregnation method in which the support is impregnated with the first catalyst metal, followed by impregnating the support with the second catalyst metal can be employed as a method for supporting the catalyst metals on the support. In the case of the sequential impregnation method, after the first catalyst metal is supported on the support, a heat treatment or the like may be performed once, followed by supporting the second catalyst metal on the support. After the impregnation of both the first catalyst metal and the second catalyst metal is completed, the first catalyst metal and the second catalyst metal are alloyed with each other or an intermetallic compound composed of the first catalyst metal and the second catalyst metal is formed by a heat treatment process.

To the reduction electrode 120 may be added a material having conductivity, such as the aforementioned conductive oxide, carbon black, or the like in addition to a conductive compound on which a catalyst metal is supported. Consequently, the number of electron-conducting paths among reduction catalyst particles can be increased, and thus resistance per geometric area of a reduction catalyst layer can be lowered in some cases.

The reduction electrode 120 may contain, as an additive, a fluorine-based resin such as polytetrafluoroethylene (PTFE).

The reduction electrode 120 may contain an ionomer having protonic conductivity. The reduction electrode 120 preferably contains ionically conducting materials (ionomers) having a structure that is identical or similar to that of the above-described electrolyte membrane 110 in a predetermined mass ratio. This allows the ionic conductivity of the reduction electrode 120 to be improved. In particular, in the case where a catalyst support is porous, the reduction electrode 120 makes a significant contribution to the improvement of the ionic conductivity by containing an ionomer that has protonic conductivity. Examples of the ionomer having protonic conductivity (which is a cation-exchanging ionomer) include perfluorosulfonic acid polymers such as Nafion (registered trademark) and Flemion (registered trademark). The ion exchange capacity (IEC) of the cation-exchanging ionomer is preferably 0.7 to 3 meq/g, more preferably 1 to 2.5 meq/g, most preferably 1.2 to 2 meq/g. When the catalyst metal is supported on porous carbon (carbon support), a mass ratio I/C of the cation-exchanging ionomer (I) to the carbon support (C) is preferably 0.1 to 2, more preferably 0.2 to 1.5, most preferably 0.3 to 1.1. It is difficult to obtain sufficient ionic conductivity if the mass ratio I/C is less than 0.1. On the other hand, if the mass ratio I/C is more than 2, the thickness of an ionomer coating over the catalyst metal is increased to inhibit the aromatic compound as a reactant from contacting a catalyst-active site, or the electron conductivity is decreased to reduce the electrode activity.

Preferably, the ionomer contained in the reduction electrode 120 partially covers a reduction catalyst. This allows three elements (an aromatic compound, a proton, and an electron), which are necessary for an electrochemical reaction at the reduction electrode 120, to be efficiently supplied to a reaction field.

The liquid diffusion layer 140*a* is laminated on the surface of the reduction electrode 120 on a side opposite to the electrolyte membrane 110. The liquid diffusion layer 140*a* plays a function of uniformly diffusing, to the reduction electrode 120, a liquid aromatic compound supplied from the separator 150*a* that is described later. As the liquid diffusion layer 140*a*, for example, carbon paper or carbon cloth is used.

The separator 150*a* is laminated on the surface of the liquid diffusion layer 140*a* on a side opposite to the electrolyte membrane 110. The separator 150*a* is formed of a carbon resin, or an anticorrosion alloy of Cr—Ni—Fe, Cr—Ni—Mo—Fe, Cr—Mo—Nb—Ni, Cr—Mo—Fe—W—Ni or the like. One or more groove-like flow channels 152*a* are provided on the surface of the separator 150*a* on the liquid diffusion layer 140*a* side. The liquid aromatic compound supplied from the organic material storage tank 30 circulates through the flow channel 152*a*, and the liquid aromatic compound penetrates into the liquid diffusion layer 140*a* from the flow channel 152*a*. The form of the flow channel 152*a* is not particularly limited, but for example, a straight flow channel or a serpentine flow channel can be employed. When a metal material is used for the separator 150*a*, the separator 150*a* may be a structure formed by sintering a ball-like or pellet-like metal fine powder.

The oxygen evolving electrode 130 is provided on the other side of the electrolyte membrane 110. As the oxygen evolving electrode 130, one that contains a catalyst based on a noble metal oxide such as $RuO_2$, $IrO_2$ or the like is suitably used. These catalysts may be supported in a dispersed manner or coated on a metal substrate such as a metal wire or mesh of metals such as Cr, Mn, Fe, Co, Ni, Cu, Zn, Nb, Mo, Ta, W, and the like or of alloys composed primarily of these metals. In particular, since $IrO_2$ is expensive, manufacturing costs can be lowered by coating the metal substrate with a thin film when $IrO_2$ is used as a catalyst.

The liquid diffusion layer 140*b* is laminated on the surface of the oxygen evolving electrode 130 on a side opposite to the electrolyte membrane 110. The liquid diffusion layer 140*b* plays a function of uniformly diffusing, to the oxygen evolving electrode 130, water supplied from the separator 150*b* that is described later. As the liquid diffusion layer 140*b*, for example, carbon paper or carbon cloth is used.

The separator 150*b* is laminated on the surface of the liquid diffusion layer 140*b* on a side opposite to the electrolyte membrane 110. The separator 150*b* is formed of an anticorrosion alloy of Cr/Ni/Fe, Cr/Ni/Mo/Fe, Cr/Mo/Nb/Ni, Cr/Mo/Fe/W/Ni, or the like or of a material formed by coating the surfaces of these metals with an oxide layer. One or more groove-like flow channels 152*b* are provided on the surface of the separator 150*b* on the liquid diffusion layer 140*b* side. Water supplied from the water storage tank 40 circulates through the flow channel 152*b*, and water penetrates into the liquid diffusion layer 140*b* from the flow channel 152*b*. The form of the flow channel 152*b* is not particularly limited, but for example, a straight flow channel or a serpentine flow channel can be employed. When a metal material is used for the separator 150*b*, the separator 150*b* may be a structure formed by sintering a ball-like or pellet-like metal fine powder.

In the present embodiment, liquid water is supplied to the oxygen evolving electrode 130, but a humidified gas (for example, air) may be used in place of water. In this case, the dew-point temperature of the humidified gas is preferably room temperature to 100° C., more preferably 50 to 100° C.

When toluene is used as the aromatic compound, reactions in the electrode unit 100 are as follows.

<Electrode Reaction at Oxygen Evolving Electrode>

$$3H_2O \rightarrow 1.5O_2 + 6H^+ + 6e^- : E_0 = 1.23\ V$$

<Electrode Reaction at Reduction Electrode>

$$\text{toluene} + 6H^+ + 6e^- \rightarrow \text{methylcyclohexane} : E^0 = 0.153\ V\ (\text{vs RHE})$$

In other words, the electrode reaction at the oxygen evolving electrode and the electrode reaction at the reduction electrode proceeds in parallel, and protons evolved by electrolysis of water are supplied to the reduction electrode via the electrolyte membrane 110 by the electrode reaction at the oxygen evolving electrode, and used for hydrogenation of a benzene ring of the aromatic compound in the electrode reaction at the reduction electrode.

Referring back to FIG. 1, the control unit 60 controls the power control unit 20 so as to gradually increase the voltage Va within a range that satisfies a relationship of $F1 \leq F0$ and $V_{CA} > V_{HER} - 20$ mV, where the potential at a reversible hydrogen electrode, the potential of the reduction electrode 120 and the acceptable upper limit of the hydrogen gas generation rate are expressed as $V_{HER}$, $V_{CA}$ and F0, respectively. The potential $V_{CA}$ can be calculated based on the reference electrode potential $V_{Ref}$ and the potential difference $\Delta V_{CA}$. If the potential $V_{CA}$ is lower than $V_{HER} - 20$ mV, competition with a hydrogen generation reaction occurs, and the reduction selectivity of the aromatic compound becomes insufficient, and thus the potential $V_{CA}$ lower than $V_{HER} - 20$ mV is not preferred. On the other hand, if the hydrogen gas generation rate is increased, Faraday efficiency is degraded. For example, the acceptable upper limit F0 of the hydrogen gas generation rate is set at such a value that Faraday efficiency becomes 50% to 90%. In other words, satisfying the relationship of $F1 \leq F0$ ensures that Faraday efficiency is 50% to 90% or higher. Therefore, the potential $V_{CA}$ can be made closer to $V_{HER} - 20$ mV by gradually increasing the voltage Va within a range that ensuring sufficiently high Faraday efficiency. As a result, the electrochemical reaction can be made to proceed efficiently at both the electrodes while the electrolytic reaction of water is suppressed, so that hydrogenation of a benzene ring of the aromatic compound can be industrially practiced.

Faraday efficiency is calculated from current density B/current density A×100(%), where the total current density passing through the electrode unit 100 is a current density A, and the current density used for reduction of the aromatic compound, which is inversely calculated from the generation rate of the hydride of a benzene ring of the aromatic compound, which is quantitatively determined by gas chromatography or the like, is a current density B.

In addition, the following reaction conditions are used for the hydrogenation of a benzene ring of the aromatic compound using the electrochemical reduction device 10. The temperature of the electrode unit 100 is preferably room temperature to 100° C., more preferably 40 to 80° C. If the temperature of the electrode unit 100 is lower than the room temperature, the proceeding of the electrolytic reaction may be slowed down, or an enormous amount of energy is required to remove heat generated as the reaction proceeds, and thus the temperature lower than room temperature is not preferred. On the other hand, if the temperature of the electrode unit 100 is higher than 100° C., water is brought to a boil at the oxygen evolving electrode 130 and the vapor pressure of an organic substance is increased at the reduction electrode 120, and thus the temperature higher than 100° C. is not preferred for the electrochemical reduction device 10 in which reactions of the both electrodes are performed in a liquid phase. The reduction electrode potential $V_{CA}$ is a true electrode potential, and therefore may be different from a potential $V_{CA_actual}$ that is actually measured. If there are resistance components, among various resistance components that exist in an electrolytic cell used in the present invention, that correspond to ohmic resistance, a resistance value per electrode area of the entirety of these components is set to be the entire ohmic resistance $R_{ohmic}$, and the true electrode potential $V_{CA}$ is calculated in accordance with the following expression.

$$V_{CA}=V_{CA_actual}\times R_{ohmic}\times(\text{current density})$$

Examples of the ohmic resistance include proton transfer resistance of the electrolyte membrane, electron transfer resistance of the electrode catalyst layer, and, furthermore, contact resistance on an electric circuit. Here, $R_{ohmic}$ can be determined as an actual resistance component on an equivalent circuit by using an alternating-current impedance measurement or an alternating-current resistance measurement at a fixed frequency, but once the configuration of an electrolytic cell and a material system to be used are determined, a method may also be used in which $R_{ohmic}$ is used in the following control while $R_{ohmic}$ is considered as an almost stationary value.

Figure 3:
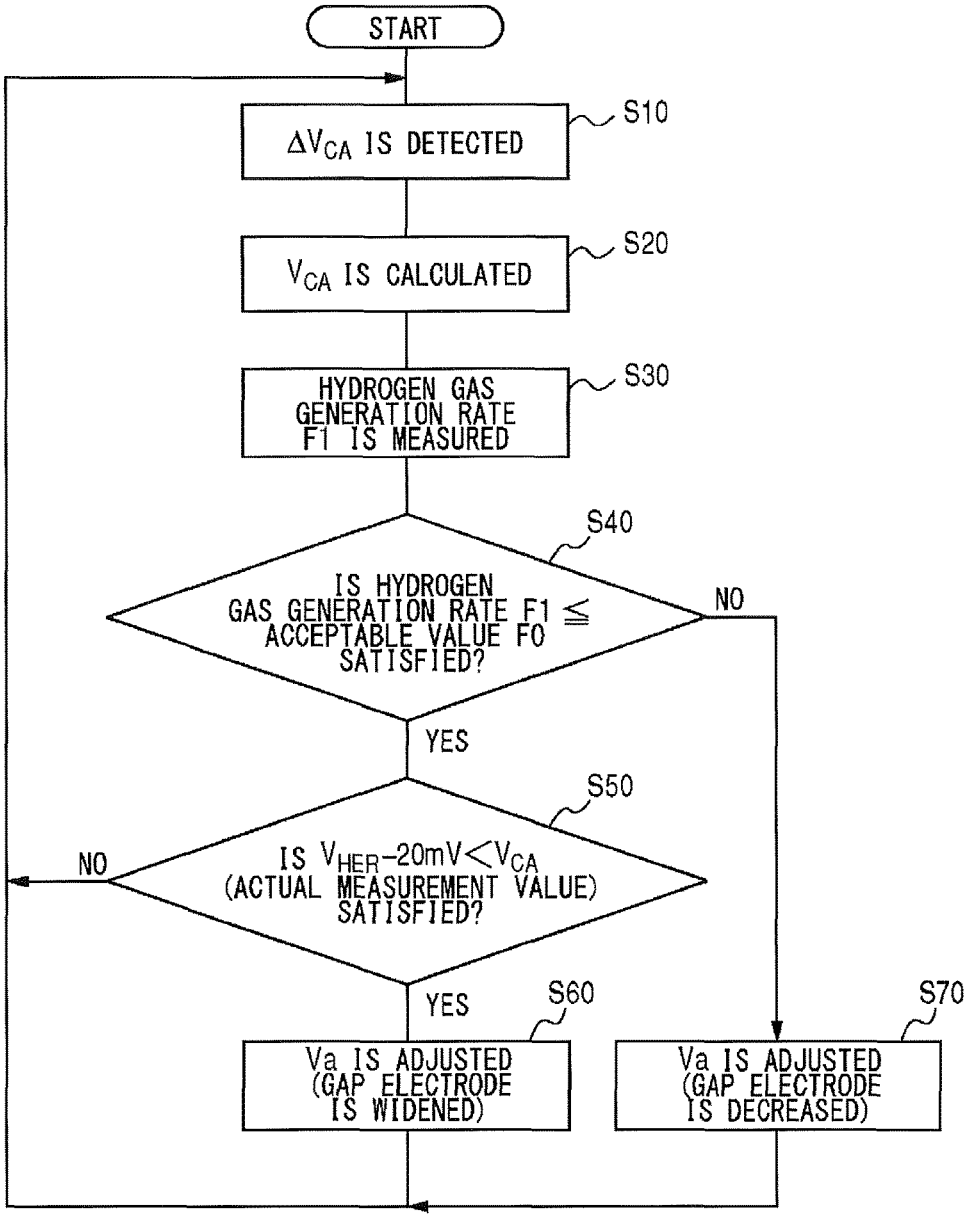
FIG. 3 is a flowchart illustrating an example of potential control of a reduction electrode by a control unit.

FIG. 3 is a flowchart illustrating an example of potential control of the reduction electrode 120 by the control unit 60. The mode of potential control of the reduction electrode 120 will be described below by using, as an example, a case where an Ag/AgCl electrode (reference electrode potential $V_{Ref}$=0.199 V) is used as the reference electrode 112.

First, reduction of the aromatic compound is started while a hydrogen gas is not generated, and thereafter a potential difference $\Delta V_{CA}$ between the reference electrode 112 and the reduction electrode 120 is detected by the voltage detection unit 114 (S10).

Next, the control unit 60 calculates a potential $V_{CA}$ (actual measurement value) of the reduction electrode 120 using (expression) $V_{CA}=\Delta V_{CA}-V_{Ref}=\Delta V_{CA}-0.199$ V (S20).

Next, a hydrogen gas generation rate F1 is measured by the hydrogen gas generation rate measurement unit 36 (S30).

The order of calculation of the potential $V_{CA}$ (actual measurement value) and measurement of the hydrogen gas generation rate F1 is not limited to the aforementioned order, and calculation of the potential $V_{CA}$ (actual measurement value) and measurement of the hydrogen gas generation rate F1 may be performed in parallel, or measurement of the hydrogen gas generation rate F1 may be performed before calculation of the potential $V_{CA}$ (actual measurement value).

Next, whether the hydrogen gas generation rate F1 satisfies the relationship of the following expression (1) is determined (S40).

$$F1\leq F0 \quad (1)$$

In the expression (1), the acceptable upper limit F0 is, for example, such a value that Faraday efficiency becomes 50% to 90%.

If the relationship of the expression (1) is not satisfied (no in S40), the voltage Va applied between the reduction electrode 120 and the oxygen evolving electrode 130 is adjusted (S70). Adjustment of the voltage Va in S70 is performed by lowering the voltage Va by a predetermined value, that is, decreasing the gap voltage between the reduction voltage 120 and the oxygen evolving electrode 130 by the control unit 60.

On the other hand, if the hydrogen gas generation rate F1 satisfies the relationship of the expression (1) (yes in S40), whether the potential $V_{CA}$ (actual measurement value) satisfies the relationship of the following expression (2) is determined (S50).

$$V_{CA}>V_{HER}-20\text{ mV} \quad (2)$$

If the relationship of the expression (2) is satisfied (yes in S50), the voltage Va applied between the reduction electrode 120 and the oxygen evolving electrode 130 is adjusted (S60). Adjustment of the voltage Va in S60 is performed by increasing the voltage Va by a predetermined value, that is, widening the gap voltage between the reduction voltage 120 and the oxygen evolving electrode 130 by the control unit 60. In an aspect, the voltage Va is increased by 1 mV in S60. After adjustment of the voltage Va, the process goes back to the process of (S10) described above. In this way, the control unit 60 gradually increases the voltage Va to a maximum within a range that satisfies the equations (1) and (2).

The value (adjustment range) for increasing the voltage Va is not limited to 1 mV. For example, the adjustment range may be set to 4 mV in the first round of adjustment, and the adjustment range of the voltage Va may be set to, for example, one-fourth of the above-described acceptable value in second and subsequent rounds of adjustment. This allows the potential $V_{CA}$ (actual measurement value) to be quickly adjusted to a maximum within a range that satisfies the expressions (1) and (2).

Preferably the voltage Va adjustment process is ended if the potential $V_{CA}$ (actual measurement value) is contemplated to be lower than $V_{HER}-20$ mV when the voltage Va is increased by a predetermined adjustment range in the next place. For example, the voltage Va adjustment process is ended if the potential $V_{CA}$ (actual measurement value) is in a range of $V_{HER}-20\text{ mV}<V_{CA}<V_{HER}-19\text{ mV}$ when the adjustment range for increasing the voltage Va is 1 mV.

On the other hand, if the relationship of the expression (2) is not satisfied (no in S50), the process goes back to the process of (S10) described above.

A stand-by time may be appropriately provided in the control flow described in FIG. 3 in consideration with a time lag until the state of hydrogen generation is changed after the voltage Va is adjusted, and a response delay.

Embodiment 2

Figure 4:
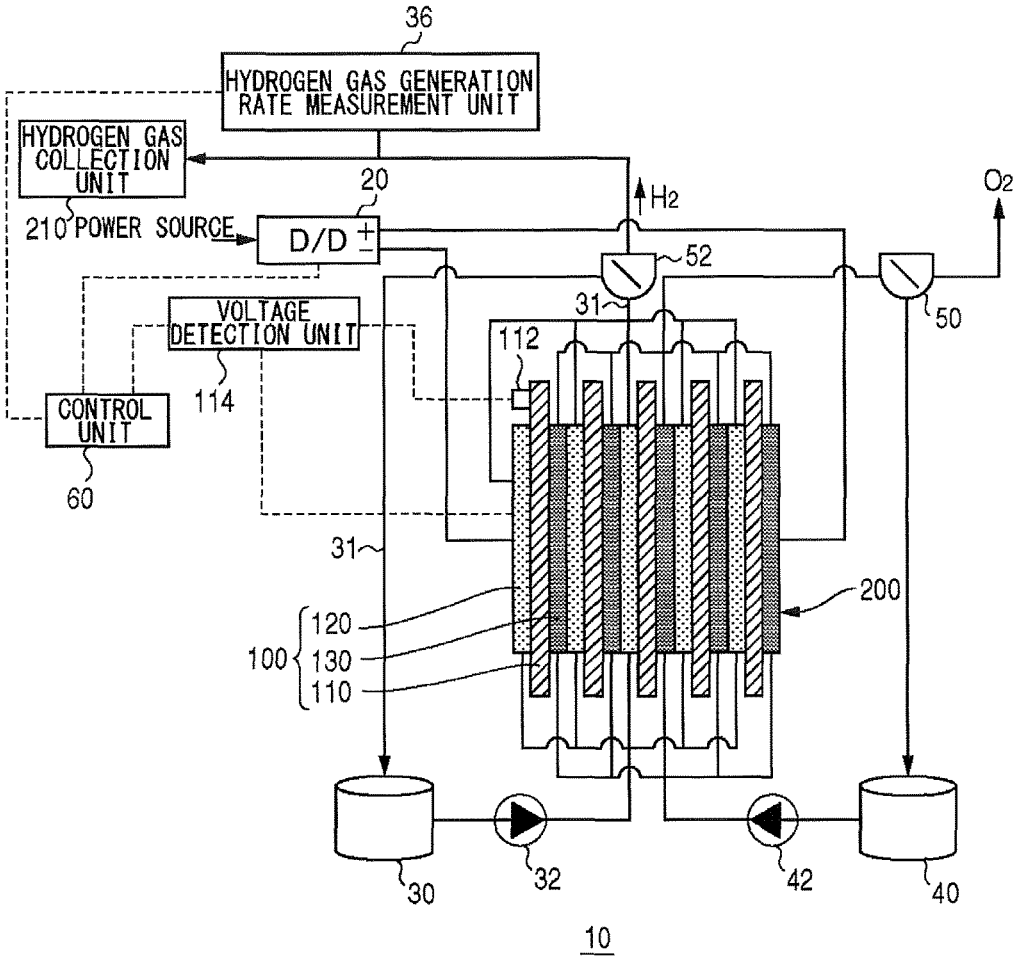
FIG. 4 is a schematic diagram illustrating the general configuration of an electrochemical reduction device according to an embodiment 2.

FIG. 4 is a schematic diagram illustrating the general configuration of an electrochemical reduction device 10 according to an embodiment 2. As shown in FIG. 4, the electrochemical reduction device 10 includes an electrode unit assembly 200, a power control unit 20, an organic material storage tank 30, a hydrogen gas generation rate measurement unit 36, a water storage tank 40, a gas-water separation unit 50, a gas-liquid separation unit 52, a control unit 60, a voltage detection unit 114 and a hydrogen gas collection unit 210. The electrode unit assembly 200 has a laminated structure where a plurality of electrode units 100 is connected in series. In the present embodiment, the number N of the electrode units 100 is five, but the number of the electrode units 100 is not limited thereto. The configuration of each electrode unit 100 is similar to the configuration in the embodiment 1. In FIG. 4, the electrode unit 100 is simplified for illustration, and the liquid diffusion layers 140*a* and 140*b* and the separators 150*a* and 150*b* are omitted.

The positive electrode output terminal of the power control unit 20 in the present embodiment is connected to the positive electrode of the electrode unit assembly 200. On the other hand, the negative electrode output terminal of the power control unit 20 is connected to the negative electrode terminal of the electrode unit assembly 200. With this, a predetermined voltage $V_A$ is applied between the positive electrode terminal and the negative electrode terminal of the electrode unit assembly 200, so that in each electrode unit 100, a reduction electrode 120 has a basic potential, and an oxygen evolving electrode 130 has a noble potential. A reference electrode input terminal of the power control unit 20 is connected to a reference electrode 112 provided on an electrolyte membrane 110 of the specific electrode unit 100 that is described later, and the potential of the positive electrode output terminal and the potential of the negative electrode output terminal are determined based on the potential of the reference electrode 112.

A first circulation pathway is provided between the organic material storage tank 30 and the reduction electrode 120 of each electrode unit 100. The aromatic compound stored in the organic material storage tank 30 is supplied to the reduction electrode 120 of each electrode unit 100 by a first liquid supply device 32. Specifically, a pipeline that forms the first circulation pathway is branched on the downstream side of the first liquid supply device 32, and the aromatic compound is supplied to the reduction electrode 120 of each electrode unit 100 in a distributed manner. Aromatic compounds in which a benzene ring is hydrogenated by the electrode units 100 and unreacted aromatic compounds merge into the pipeline 31 that communicates with the organic material storage tank 30, then pass through the pipeline 31, and are stored in the organic material storage tank 30. A gas-liquid separation unit 52 is provided in the middle of the pipeline 31, and hydrogen circulating through the pipeline 31 is separated by the gas-liquid separation unit 52.

Figure 5:
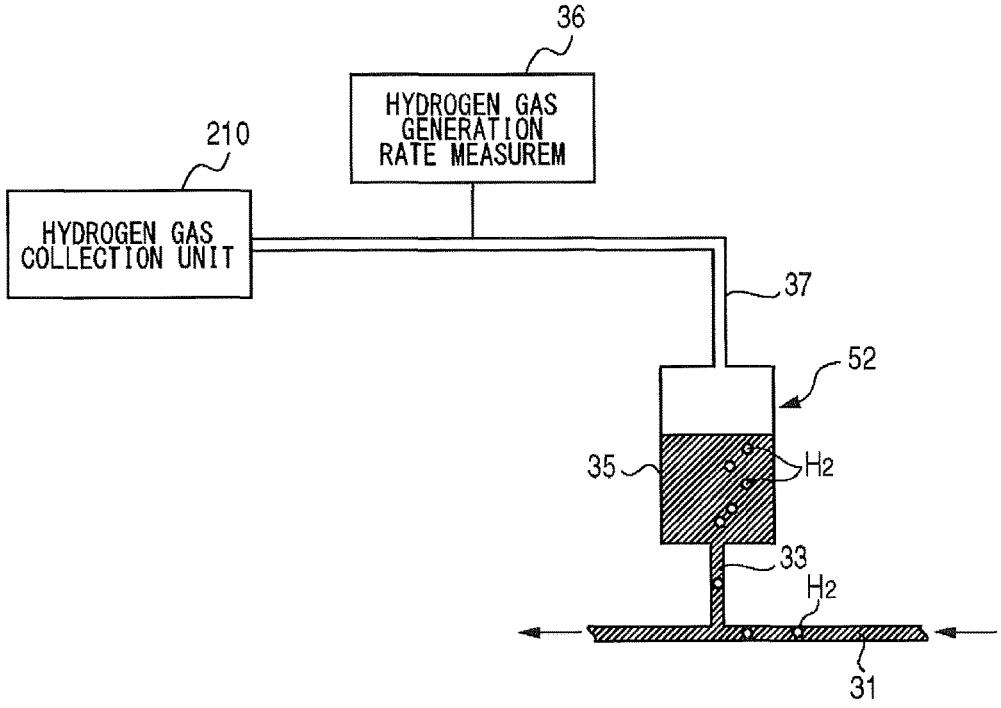
FIG. 5 is a diagram illustrating a specific example of a gas-liquid separation unit.

FIG. 5 is a diagram illustrating a specific example of the gas-liquid separation unit 52. A branched pipe 33 that is branched upward from the pipeline 31 is provided. The branched pipe 33 is connected to the bottom part of a storage tank 35. The liquid aromatic compound flows into the storage tank 35 through the branched pipe 33, so that the liquid level in the storage tank 35 is maintained at a predetermined level. A hydrogen gas flowing through the pipeline 31 together with the aromatic compound from the upstream side of a branched site of the branched pipe 33 toward the branched site goes upward through the branched pipe 33 to reach the storage tank 35, and enters a gas phase on the liquid level in the storage tank 35. The hydrogen gas of the gas phase then passes through a discharge pipe 37 connected in the upper part of the storage tank 35, and is collected by a hydrogen gas collection unit 210. The hydrogen gas generation rate measurement unit 36 is provided in the middle of the discharge pipe 37, and the generation rate F1' of the hydrogen gas generated from all the electrode units 100 included in the electrode unit assembly 200 is measured. In the present embodiment, the hydrogen gas generation rate measurement unit 36 is a flowmeter for detecting the amount of the hydrogen gas passing through the discharge pipe 37. A fixed amount of nitrogen gas may be supplied to the discharge pipe 37 at the upstream of the hydrogen gas generation rate measurement unit 36. This allows accurate detection of a change in concentration of the hydrogen gas passing through the discharge pipe 37.

In the embodiment described above, a flowmeter is shown as an example of the hydrogen gas generation rate measurement unit 36, but the hydrogen gas generation rate measurement unit 36 is not limited thereto. For example, as the hydrogen gas generation rate measurement unit 36, a form in which a relief valve is provided in the discharge pipe 37 can be used. For example, the relief valve is configured such that the valve is opened when the gas pressure in the discharge pipe 37 on the upstream side of the relief valve, and the valve is closed after a fixed amount of gas is discharged to the downstream side of the relief valve. In this case, each time the relief valve is opened, a signal indicating that the relief valve is opened is sent to the control unit 60. The control unit 60 estimates a generation rate of the hydrogen gas based on the amount of gas discharged per opening of the relief valve and the number of times the relief valve is opened per unit time.

In the present embodiment, the flow rate of the hydrogen gas separated by the gas-liquid separation unit 52 is measured by the hydrogen gas generation rate measurement unit 36, but an optical sensor similar to that in the embodiment 1 may be provided on the upstream side of the gas-liquid separation unit 52 and on the downstream side of a confluence at which pipelines from the electrode units 100 merge. In the embodiment 1, a mode may be employed in which the flow rate of the hydrogen gas separated by the gas-liquid separation unit 52 is measured by the hydrogen gas generation rate measurement unit 36 as in the embodiment 2.

A second circulation pathway is provided between the water storage tank 40 and the oxygen evolving electrode 130 of each electrode unit 100. Water stored in the water storage tank 40 is supplied to the oxygen evolving electrode 130 of each electrode unit 100 by a second liquid supply device 42. Specifically, a pipeline that forms the second circulation pathway is branched on the downstream side of the second liquid supply device 42, and water is supplied to the oxygen evolving electrode 130 of each electrode unit 100 in a distributed manner. Unreacted water in each electrode unit 100 merges into a pipeline that communicates with the water storage tank 40, then passes through the pipeline and is stored in the water storage tank 40.

On the electrolyte membrane 110 of the specific electrode unit 100, a reference electrode 112 is provided in an area spaced apart from the reduction electrode 120 and the oxygen evolving electrode 130 in such a manner that the reference electrode 112 is in contact with the electrolyte membrane 110 as in the embodiment 1. The specific electrode unit 100 should be any one of the plurality of electrode units 100.

A potential difference $\Delta V_{CA}$ between the reference electrode 112 and the reduction electrode 120 is detected by a voltage detection unit 114. The value of the potential difference $\Delta V_{CA}$ detected by the voltage detection unit 114 is input to the control unit 60.

The control unit 60 controls the power control unit 20 so as to gradually increase the voltage $V_A$ within a range that satisfies a relationship of $F1' \leq N \times F0$ and $V_{CA} > V_{HER} - 20$ mV, where the potential at a reversible hydrogen electrode, the potential of the reduction electrode 120, the acceptable upper limit of the hydrogen gas generation rate per electrode unit and the number of electrode units 100 are expressed as $V_{HER}$, $V_{CA}$, F0 and N (N is 5 in the present embodiment) respectively.

According to the present embodiment, hydrogenation of a benzene ring of an aromatic compound can be made to proceed in parallel in a plurality of electrode units 100, and therefore the amount of hydrogenation of a benzene ring of the aromatic compound per unit time can be dramatically increased. Therefore, hydrogenation of a benzene ring of the aromatic compound can be industrially practiced.

The present invention is not limited to the above-mentioned embodiments, and various modifications, such as a design change, can be added thereto on the basis of knowledge of those skilled in the art, and any embodiment to which such modifications are added can also be included in the scope of the present invention.

In the above-described embodiments, the electrolyte membrane 110 and the reduction electrode 120 contain an ionomer having protonic conductivity, but the electrolyte membrane 110 and the reduction electrode 120 may contain ionomer having hydroxy ion conductivity.

In the embodiment 2, the reference electrode 112 is provided on the electrolyte membrane 110 of one electrode unit 100, but the reference electrode 112 may be provided on the electrolyte membranes 110 of a plurality of electrode units 100. In this case, a potential difference $\Delta V_{CA}$ between each reference electrode 112 and the corresponding reduction electrode 120 is detected by the voltage detection unit 114, and a potential $V_{CA}$ is calculated by using an average value of a plurality of potential differences $\Delta V_{CA}$ that are detected. This allows the voltage $V_A$ to be adjusted to be in a more appropriate range when variation in potential is caused among the electrode units 100.

The embodiments described above will be summarized below.

[Item 1]

An electrochemical reduction device comprising:

an electrode unit including an electrolyte membrane having ionic conductivity, a reduction electrode that is provided on one side of the electrolyte membrane and that contains a reduction catalyst for hydrogenating a benzene ring of an aromatic hydrocarbon compound or a nitrogen-containing heterocyclic aromatic compound, and an oxygen evolving electrode that is provided on the other side of the electrolyte membrane;

a power control unit that applies a voltage Va between the reduction electrode and the oxygen evolving electrode so that the reduction electrode has a basic potential and the oxygen evolving electrode has a noble potential;

a hydrogen gas generation rate measurement unit that measures a generation rate F1 per unit time of a hydrogen gas generated by an electrolytic reaction of water which competes with a benzene ring hydrogenation reaction of the aromatic hydrocarbon compound or the nitrogen-containing heterocyclic aromatic compound; and a control unit that controls the power control unit so as to gradually increase the voltage Va within a range that satisfies a relationship of $F1 \leq F0$ and $V_{CA} > V_{HER}$−(acceptable potential difference), where the potential at a reversible hydrogen electrode, the potential of the reduction electrode and the acceptable upper limit of the hydrogen gas generation rate are expressed as $V_{HER}$, $V_{CA}$ and F0, respectively, and the acceptable potential difference is defined as a potential difference that defines an upper limit of a potential difference between $V_{CA}$ and $V_{HER}$.

[Item 2]

The electrochemical reduction device according to Item 1, wherein the acceptable potential difference is 20 mV.

[Item 3]

The electrochemical reduction device according to Item 1 or Item 2, further comprising:

a reference electrode that is arranged to be in contact with the electrolyte membrane and to be electrically isolated from the reduction electrode and the oxygen evolving electrode and that is held at a reference electrode potential $V_{Ref}$; and a voltage detection unit that detects a potential difference $\Delta V_{CA}$ between the reference electrode and the reduction electrode, wherein the control unit acquires the potential $V_{CA}$ of the reduction electrode based on the potential difference $\Delta V_{CA}$ and the reference electrode potential $V_{Ref}$.

[Item 4]

An electrochemical reduction device comprising:

an electrode unit assembly in which a plurality of electrode units are electrically connected to one another in series, the electrode units each including an electrolyte membrane having ionic conductivity, a reduction electrode that is provided on one side of the electrolyte membrane and that contains a reduction catalyst for hydrogenating a benzene ring of an aromatic hydrocarbon compound or a nitrogen-containing heterocyclic aromatic compound, and an oxygen generating electrode that is provided on the other side of the electrolyte membrane;

a power control unit that applies a voltage $V_A$ between a positive electrode terminal and a negative electrode terminal of the electrode unit assembly so that in each electrode unit, the reduction electrode has a basic potential and the oxygen generating electrode has a noble potential;

a hydrogen gas generation rate measurement unit that measures a generation rate F1' per unit time of a hydrogen gas generated by an electrolytic reaction of water which competes with a benzene ring hydrogenation reaction of the aromatic hydrocarbon compound or the nitrogen-containing heterocyclic aromatic compound in the whole of the plurality of electrode units; and a control unit that controls the power control unit so as to gradually increase the voltage $V_A$ within a range that satisfies a relationship of $F1' \leq N \times F0$ and $V_{CA} > V_{HER}$−(acceptable potential difference), where the potential at a reversible hydrogen electrode, the potential of the reduction electrode, the acceptable upper limit of the hydrogen gas generation rate per electrode unit and the number of electrode units are expressed as $V_{HER}$, $V_{CA}$, F0 and N, respectively, and the acceptable potential difference is defined as a potential difference that defines an upper limit of a potential difference between $V_{CA}$ and $V_{HER}$.

[Item 5]

The electrochemical reduction device according to Item 4, wherein the acceptable potential difference is 20 mV.

[Item 6]

The electrochemical reduction device according to Item 4 or Item 5, further comprising:

a reference electrode that is arranged to be in contact with the electrolyte membrane of any one of the electrode units included in the electrode unit assembly and to be electrically isolated from the reduction electrode and the oxygen evolving electrode of the electrode unit; and a voltage detection unit that detects a potential difference $\Delta V_{CA}$ between the reference electrode and the reduction electrode of the electrode unit, wherein the control unit acquires the potential $V_{CA}$ of the reduction electrode of the electrode unit based on the potential difference $\Delta V_{CA}$ and the reference electrode potential $V_{Ref}$.

[Item 7]

A method for manufacturing a hydride of an aromatic hydrocarbon compound or a nitrogen-containing heterocyclic aromatic compound, comprising introducing an aromatic hydrocarbon compound or a nitrogen-containing heterocyclic aromatic compound to the reduction electrode side of the electrode unit, circulating water or a humidified gas to the oxygen evolving electrode side, and hydrogenating a benzene ring of the aromatic hydrocarbon compound or the nitrogen-containing heterocyclic aromatic compound introduced to the reduction electrode side, by using the electrochemical reduction device according to any one of Items 1 through 6.

[Item 8]

The method for manufacturing a hydride of an aromatic hydrocarbon compound or a nitrogen-containing heterocyclic aromatic compound according to Item 7, wherein the aromatic hydrocarbon compound or the nitrogen-containing heterocyclic aromatic compound to be introduced to the reduction electrode side is introduced to the reduction electrode side in a liquid state at a reaction temperature.

What is claimed is:

1. An electrochemical reduction device comprising:

an electrode unit including an electrolyte membrane having ionic conductivity, a reduction electrode that is provided on one side of the electrolyte membrane and that contains a reduction catalyst for hydrogenating a benzene ring of an aromatic hydrocarbon compound or a nitrogen-containing heterocyclic aromatic compound, and an oxygen evolving electrode that is provided on the other side of the electrolyte membrane;

a power control unit that applies a voltage Va between the reduction electrode and the oxygen evolving electrode so that the reduction electrode has a basic potential and the oxygen evolving electrode has a noble potential;

a hydrogen gas generation rate measurement unit that measures a generation rate F1 per unit time of a hydrogen gas generated by an electrolytic reaction of water which competes with a benzene ring hydrogenation reaction of the aromatic hydrocarbon compound or the nitrogen-containing heterocyclic aromatic compound; and a control unit that controls the power control unit so as to gradually increase the voltage Va within a range that satisfies a relationship of $F1 \leq F0$ and $V_{CA} > V_{HER}$−(acceptable potential difference), where the potential at a reversible hydrogen electrode, the potential of the reduction electrode and the acceptable upper limit of the hydrogen gas generation rate are expressed as $V_{HER}$, $V_{CA}$ and F0, respectively, and the acceptable potential difference is defined as a potential difference that defines an upper limit of a potential difference between $V_{CA}$ and $V_{HER}$.

2. The electrochemical reduction device according to claim 1, wherein the acceptable potential difference is 20 mV.

3. The electrochemical reduction device according to claim 1, further comprising:

a reference electrode that is arranged to be in contact with the electrolyte membrane and to be electrically isolated from the reduction electrode and the oxygen evolving electrode and that is held at a reference electrode potential $V_{Ref}$; and a voltage detection unit that detects a potential difference $\Delta V_{CA}$ between the reference electrode and the reduction electrode, wherein the control unit acquires the potential $V_{CA}$ of the reduction electrode based on the potential difference $\Delta V_{CA}$ and the reference electrode potential $V_{Ref}$.

4. An electrochemical reduction device comprising:

an electrode unit assembly in which a plurality of electrode units are electrically connected to one another in series, the electrode units each including an electrolyte membrane having ionic conductivity, a reduction electrode that is provided on one side of the electrolyte membrane and that contains a reduction catalyst for hydrogenating a benzene ring of an aromatic hydrocarbon compound or a nitrogen-containing heterocyclic aromatic compound, and an oxygen generating electrode that is provided on the other side of the electrolyte membrane;

a power control unit that applies a voltage $V_A$ between a positive electrode terminal and a negative electrode terminal of the electrode unit assembly so that in each electrode unit, the reduction electrode has a basic potential and the oxygen generating electrode has a noble potential;

a hydrogen gas generation rate measurement unit that measures a generation rate F1' per unit time of a hydrogen gas generated by an electrolytic reaction of water which competes with a benzene ring hydrogenation reaction of the aromatic hydrocarbon compound or the nitrogen-containing heterocyclic aromatic compound in the whole of the plurality of electrode units; and a control unit that controls the power control unit so as to gradually increase the voltage $V_A$ within a range that satisfies a relationship of $F1' \leq N \times F0$ and $V_{CA} > V_{HER}$−(acceptable potential difference), where the potential at a reversible hydrogen electrode, the potential of the reduction electrode, the acceptable upper limit of the hydrogen gas generation rate per electrode unit and the number of electrode units are expressed as $V_{HER}$, $V_{CA}$, F0 and N, respectively, and the acceptable potential difference is defined as a potential difference that defines an upper limit of a potential difference between $V_{CA}$ and $V_{HER}$.

5. The electrochemical reduction device according to claim 4, wherein the acceptable potential difference is 20 mV.

6. The electrochemical reduction device according to claim 4, further comprising:

a reference electrode that is arranged to be in contact with the electrolyte membrane of any one of the electrode units included in the electrode unit assembly and to be electrically isolated from the reduction electrode and the oxygen evolving electrode of the electrode unit; and a voltage detection unit that detects a potential difference $\Delta V_{CA}$ between the reference electrode and the reduction electrode of the electrode unit, wherein the control unit acquires the potential $V_{CA}$ of the reduction electrode of the electrode unit based on the potential difference $\Delta V_{CA}$ and the reference electrode potential $V_{Ref}$.

7. A method for manufacturing a hydride of an aromatic hydrocarbon compound or a nitrogen-containing heterocyclic aromatic compound, comprising introducing an aromatic hydrocarbon compound or a nitrogen-containing heterocyclic aromatic compound to the reduction electrode side of the electrode unit, circulating water or a humidified gas to the oxygen evolving electrode side, and hydrogenating a benzene ring of the aromatic hydrocarbon compound or the nitrogen-containing heterocyclic aromatic compound introduced to the reduction electrode side, by using the electrochemical reduction device according to claim 1.

8. The method for manufacturing a hydride of an aromatic hydrocarbon compound or a nitrogen-containing heterocyclic aromatic compound according to claim 7, wherein the aromatic hydrocarbon compound or the nitrogen-containing heterocyclic aromatic compound to be introduced to the reduction electrode side is introduced to the reduction electrode side in a liquid state at a reaction temperature.

* * * * *